US005967645A

United States Patent [19]

Anderson

[11] Patent Number: 5,967,645

[45] Date of Patent: Oct. 19, 1999

[54] LIGHT PROJECTION APPARATUS FOR PROJECTING A LINE OF GENERALLY CONSTANT ILLUMINATION ON A SURFACE

[76] Inventor: Nigel Iivari Anderson, Afgen House, 26 Kyalami Boulevard, Kyalami Business Park, Midrand, South Africa, 1685

[21] Appl. No.: 08/930,498

[22] PCT Filed: Apr. 4, 1996

[86] PCT No.: PCT/GB96/00844

§ 371 Date: Dec. 29, 1997

§ 102(e) Date: Dec. 29, 1997

[87] PCT Pub. No.: WO96/31322

PCT Pub. Date: Oct. 10, 1996

[30] Foreign Application Priority Data

Apr. 4, 1995 [ZA] South Africa ..... 95/2742

[51] Int. Cl.[6] ..... F27K 21/00

[52] U.S. Cl. ..... 362/259; 362/335

[58] Field of Search ..... 362/259, 335, 362/337, 311, 339; 83/521; 372/101, 109

[56] References Cited

U.S. PATENT DOCUMENTS

| | | | |
|---|---|---|---|
| 4,609,978 | 9/1986 | Hsieh et al. | 362/335 |
| 5,285,708 | 2/1994 | Bosten et al. | 83/520 |
| 5,446,635 | 8/1995 | Jehn | 362/259 |
| 5,768,017 | 6/1998 | King et al. | 359/559 |
| 5,788,588 | 8/1998 | Hooker | 473/409 |

*Primary Examiner*—Sandra O'Shea
*Assistant Examiner*—Michael J. Smith
*Attorney, Agent, or Firm*—Birch, Stewart, Kolasch & Birch, LLP

[57] ABSTRACT

A light projection apparatus for projecting an illuminated line onto a surface which comprises a light source for emitting a light beam and a light beam deflection lens which is adapted to receive the emitted light beam and project a work light beam which will be visible as a straight line on the surface, the light deflection lens is configured so that the visible line on the surface is of generally equal illumination along its entire length. The light beam deflection lens preferably comprises an optical lens which is adapted to refract and reflect the emitted light beam.

11 Claims, 3 Drawing Sheets

LIGHT PROJECTION APPARATUS FOR PROJECTING A LINE OF GENERALLY CONSTANT ILLUMINATION ON A SURFACE

BACKGROUND OF THE INVENTION

1. Field of the Invention

This invention relates to a light projection apparatus, in particular, an apparatus for projecting an illuminated line onto a workpiece.

2. Description of the Prior Art

In a number of industries, for example, timber sawmills, stone masonry, the textile industry, etc., frequently a requirement is to saw, grind or cut the products concerned along straight lines, which may be of considerable lengths, sometimes up to 12 meters or more.

The conventional methods of guiding the cutting machinery involved include the use of chalk lines, strips, straight edge rules and so forth. These methods are clumsy, difficult to apply and are easily displaced by the operations in progress.

More recently, the use of lasers projecting a long thin line of light on the workpiece have come into use. This system represents a major improvement over the older conventional methods. However, a disadvantage of existing laser systems, particularly where very long lines are required, is that the intensity of the light is greatly reduced towards the far end of the projected line, and this, combined with the unavoidable small angle of incidence of the bream on to the workpiece at the far area, makes if difficult to distinguish the line clearly.

The known art utilizes a lens system comprising a solid cylindrical glass rod to fan out the rays of a laser beam to produce a line of laser light on the surface of the object when the beam is projected on to such an object.

In FIG. 1, curve C1 shows the comparative intensities of the light produced by this system at different angles emanating from the light source. As can be seen, the intensity is greatest over the center portion of the beam (at x), gradually reducing to zero towards the outer ends of the beam.

FIG. 2 shows a typical layout of an arrangement for projecting a line of light AB, from laser 1, on to a workpiece. Curve C2 shows the comparative brightness resulting at various points along this line. As can be seen, bright illumination is provided on the portion of the line nearer to the light source, while on the portion further from the source the level of illumination is substantially lower. This is accounted for by a combination of factors, each of which materially contributes to this unsatisfactory situation.

The factors are:

1. The greater distance from the light source.
2. The comparatively lower intensity of light emanating from the lens in the outer portion of the beam.
3. The very oblique angle at which the light strikes the surface of the workpiece at this end of the line, resulting in an already reduced relative light intensity being spread over a long length of the line.

A device sometimes employed to improve this result is to offset the solid cylindrical lens from the center line of the laser beam. This results in a higher proportion of light being projected from the lens to one side of the beam as compared with the other side. Curve D in FIG. 1 illustrates the comparative light intensities obtained with such a prior art device in which the beam from the light source is offset from the axis of the lens used to deflect the beam onto the work surface. This effect is utilized to increase to some extent, the portion of light transmitted to the more distant portion of the line. However, even with this modification, the variation in illumination of the line from one end to the other is considerable.

DE 43 20 177 discloses a light projection apparatus which is used to project an illuminated line onto a surface. The disclosed apparatus utilizes a laser source to emitting a laser beam. A specially shaped prism receives the emitted laser beam and refracts it in such a way as to produce a fanned beam which forms a line of light on the surface. There is a generally constant intensity of illumination in the line of light.

Apart from the difficulties of manufacturing the specially shaped prism to achieve the desired refraction, the disclosed apparatus has the disadvantage that it the fanned laser beam is projected symmetrically onto the surface about an axis at right angles to the surface. This makes it unsuitable from projecting rather long illuminated lines onto the surface, because the longer the line, the further away from the surface the laser projection apparatus must be situated.

Therefore, in light of the deficiencies of the prior art, it is an object of the invention to provide a system in which a line of laser light may be projected on to a surface situated obliquely relative to the light source, such a line of light being substantially evenly illuminated throughout its length, and thus more easily visible at all points along its length.

SUMMARY OF THE INVENTION

According to the present invention, there is provided a light projection apparatus for projecting an illuminated line onto a surface, a laser source for emitting a laser beam, and optical lens means which is arranged to receive the emitted laser beam and to project, onto the surface, a work light beam having a fanned planar configuration which will be visible as a straight line on the surface, thereby to form an illuminated line on the surface.

The laser source and optical lens means are arranged such that the working laser beam is projected obliquely onto the surface to form an illuminated line extending from a near position close to the optical lens means to a far position remote from the optical lens means. The optical lens means comprises a cylindrical hollow lens having internal and external surfaces, the arrangement of the internal and external surfaces being such that the optical lens means both refract and reflects the emitted laser beam to produce a working laser beam which has higher light intensity in portions of the beam which are projected onto the surface towards the far position than in portions of the beam which are projected onto the surface towards the near position, whereby the illuminated line has generally equal illumination along its length between the near and far positions.

The optical lens is preferably configured so as to produce a work light beam which increases in intensity in a direction away from the light beam deflection means and is preferably a lens of generally cylindrical configuration having concentric concave and convex surfaces, the lens being adapted to reflect and refract the emitted beam to produce the fanned work light beam. The lens is typically of a hollow generally circular cylindrical configuration which is orientated such that its longitudinal axis is substantially perpendicular to the axis of the emitted light beam.

In a preferred embodiment of the invention, the emitted beam has a diameter which is less than half the diameter of the lens, the emitted beam impinging on the lens to one side of the longitudinal axis of the lens. The apparatus is typically mounted to a support rail. The apparatus is preferably able to move along the support rail and tilt relative to the support rail in order to position the work line in a desired position and with a desired angle of incidence relative to the surface.

The light source for emitting a light beam is usually a laser diode, although a Helium-Neon plasma tube may also be used. When a Helium-Neon plasma tube is used, an anamorphic lens is preferably positioned between the plasma tube and the light beam deflection means in order to produce an elliptical shaped work beam.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 3:
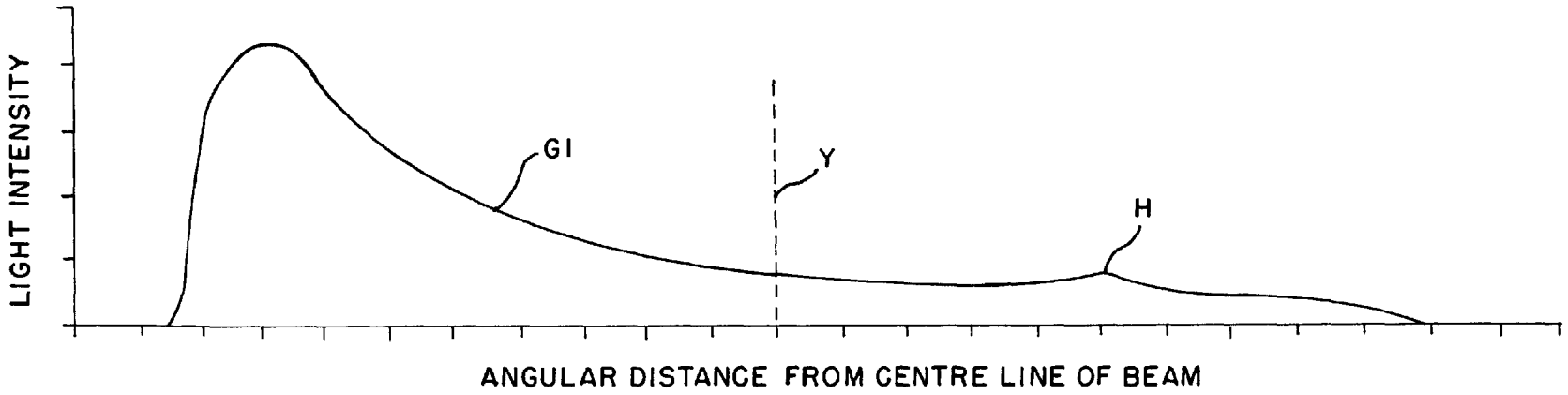
FIG. 3 shows the pattern of light distribution emerging from an embodiment of the light projection apparatus of the invention.

In FIG. 3, curve G1 shows diagrammatically the pattern of light distribution emerging from a light projection apparatus of the invention. As can be seen, the intensity of the light is greatest near an edge of the beam at a fairly large distance from the center of the beam (at y).

Figure 4:
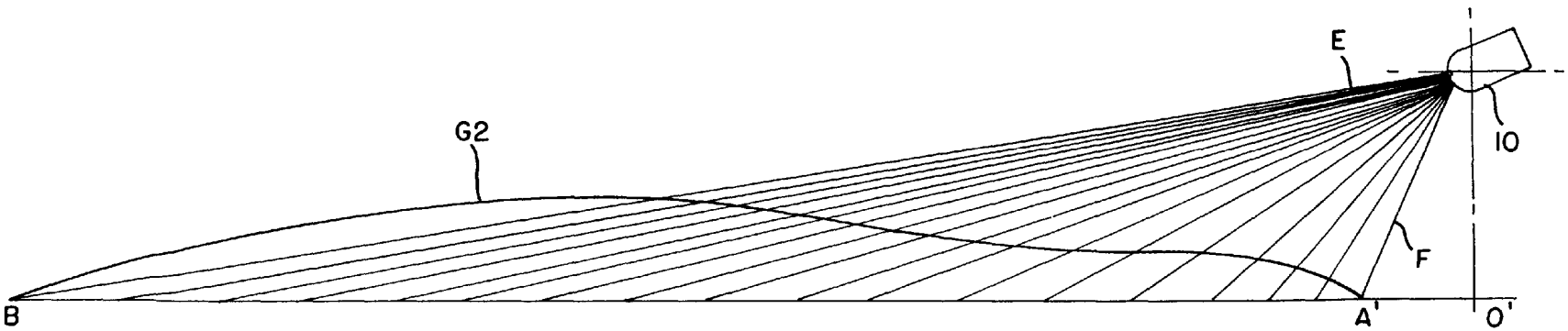
FIG. 4 shows the arrangement of the light projection apparatus of the invention for producing the pattern of light intensities of FIG. 3.

Referring to FIG. 4, the intensity of light emerging from the optical system of the invention is highly concentrated in the upper portion of the beam (at E), trailing off more or less exponentially to a much lower intensity in the lower portion of the beam (at F). The result is that a substantial amount of light is projected on to the far portion of the line towards the end B.

The combination of these factors results in the line of light AB being more or less evenly illuminated along its full length, as illustrated in curve G2.

Figure 5:
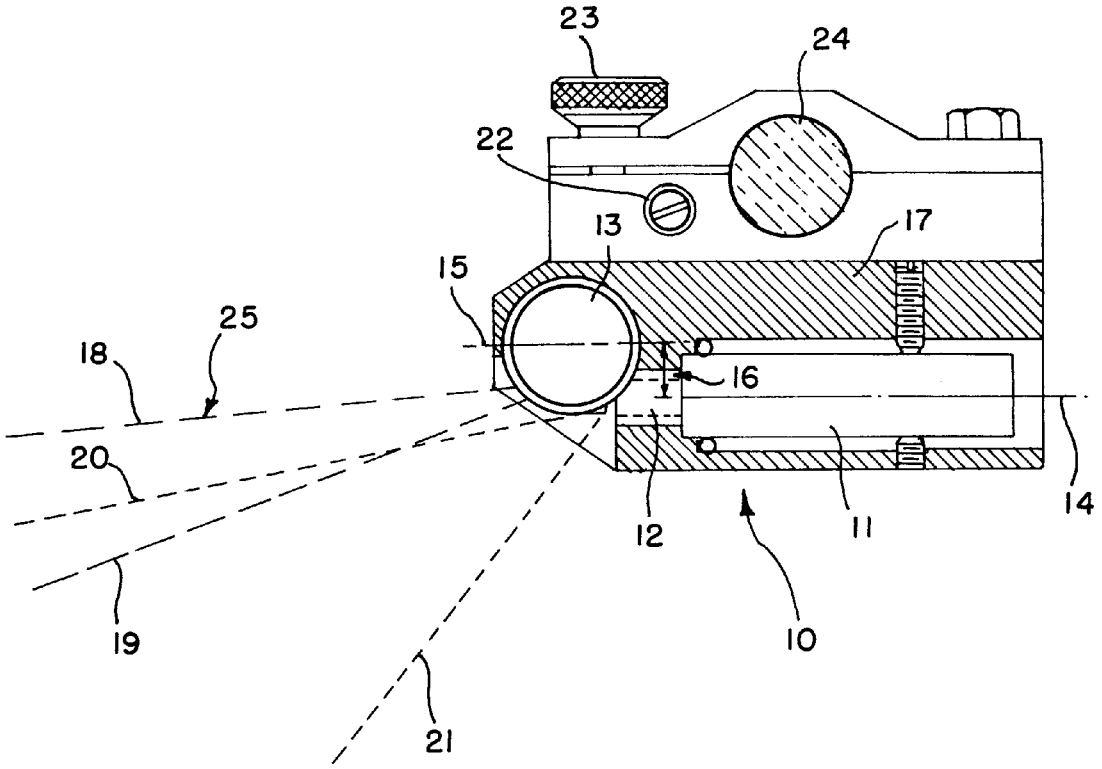
FIG. 5 is a cross-section view of a preferred embodiment of the invention.

Referring to FIG. 5, a light projection apparatus 10 comprises a laser diode module 11 which shines a beam of laser light 12 on to a hollow cylindrical lens 13. The center line 14 of the laser beam 12 is spaced from the center line 15 of the lens 13 by an off-set distance 16. The beam 12 is refracted and reflected into a fanned configuration. The refracted rays are produced nearer the center line 15 of the lens between the illustrative rays 18 and 19, while the reflected rays are produced further away from the center line 15 between illustrative rays 20 and 21. One point of interest in the curve shown in FIG. 3 is the point H which depicts increased intensity in the region where reflected and refracted light emitting from the light protection apparatus overlap.

The diode module 11 should be orientated so that the major axis of beam 12 is at right angles to the axis of lens 13, and the offset distance 16 may preferably be such that the lower limit of beam 12 does not pass the lower surface of lens 13.

The effect of using a hollow cylindrical lens 13, off-set from the laser beam 12, is that the refracted rays emerging from nearer the center line of the lens are closely spaced radially, while those emerging further away are progressively more widely spaced radially.

In the case of the reflected rays, those further from the center line of lens 13 are reflected less than those closer to the center line of the lens. Reflection occurs from both the external and internal surfaces of the lens. For this reason it is preferable to use a lens without an anti-reflection coating.

The proportion of light reflected is considerably less than the proportion refracted, but with suitable adjustment of the amount, of offset of the lens, the intenser portion of the reflected rays overlap part of the less intense portion of the refracted rays, thus resulting in a homogenous line of light on the workpiece, and providing a wider usable angular spread of the beam.

This overlapping reflected portion causes a slight increase in light intensity over a small part of the intensity curve, as indicated by the slight "hump" H in the curve, the effect of which is not significant. (refer to FIG. 3).

However, what is of considerable importance is the extension of the curve, which results in significant modification of the light distribution pattern on the workpiece. The pattern of light distribution thus obtained provides a near-ideal distribution of light along the full length of the line, even where an extremely long line relative to the height of the light source is required.

The preferred embodiment described above employs a laser diode as the light source. However, it is also possible to employ a Helium-Neon plasma tube as the light source, preferably in conjunction with an anamorphic lens positioned between the laser and the hollow cylindrical lens to produce an elliptical shaped beam.

A wide range of sizes of hollow cylindrical lenses may be used. It is also possible to use other configurations of lenses and light reflection devices such as curved mirrors or the like. The use of hollow cylindrical lenses for the applications described above represent a simple means of achieving the required pattern of light distribution.

It can be seen from FIG. 5 that only a portion of the lens is utilized. Thus, if preferred, it is possible to incorporate just a segment of a hollow cylindrical lens into the device. Hollow cylindrical lenses are in effect convex-concave lenses of which the outer and inner radii have a common center. However, it is also possible to use convex/concave lenses of which the radii have separate centers.

The apparatus of the invention will preferably be mounted on a rail which is aligned perpendicular to the plane of the work light beam; furthermore, the apparatus will be slidable along the rail so that the position of the beam, relative to a surface or workpiece, can be varied. The rail is preferably circular in cross-section and the apparatus may be rotatable on the rail.

The apparatus is also movable along the length of the rail so that the illuminated line on the work surface can be positioned as desired. In addition, fine angular adjustment of the beam is possible. That is, it will be possible to adjust the angle of the beam relative to the axis of the rail by means of a fine adjustment of the screw numbered 22 in the drawings. This will allow the surface line to coincide with a required datum or other feature on the workpiece.

Figure 6:
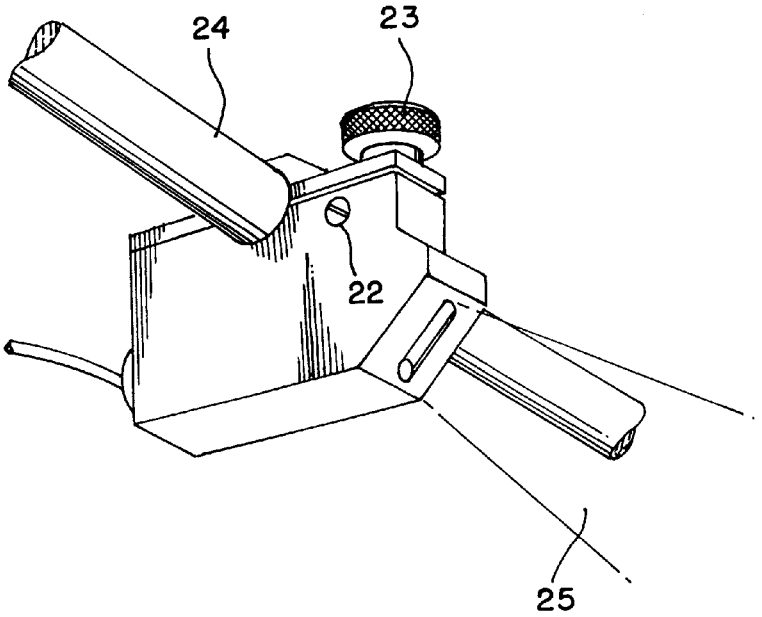
FIG. 6 shows a perspective view of an apparatus according to the invention.

FIG. 6 depicts a perspective view of the apparatus in operation. The apparatus includes a clamping screw 23 for clamping the apparatus to the rail 24. As previously mentioned, the apparatus is rotatable on the rail 24 and is also slidable lengthwise along the length of the rail. In addition, the angle of the apparatus relative to the rail is adjustable by means of the screw 22, so that the beam 25 emitting from the apparatus can be angled relative to the longitudinal axis of the rail. It is envisaged that the angle of adjustment of the beam will be between 10° and 15°.

Figure 1:
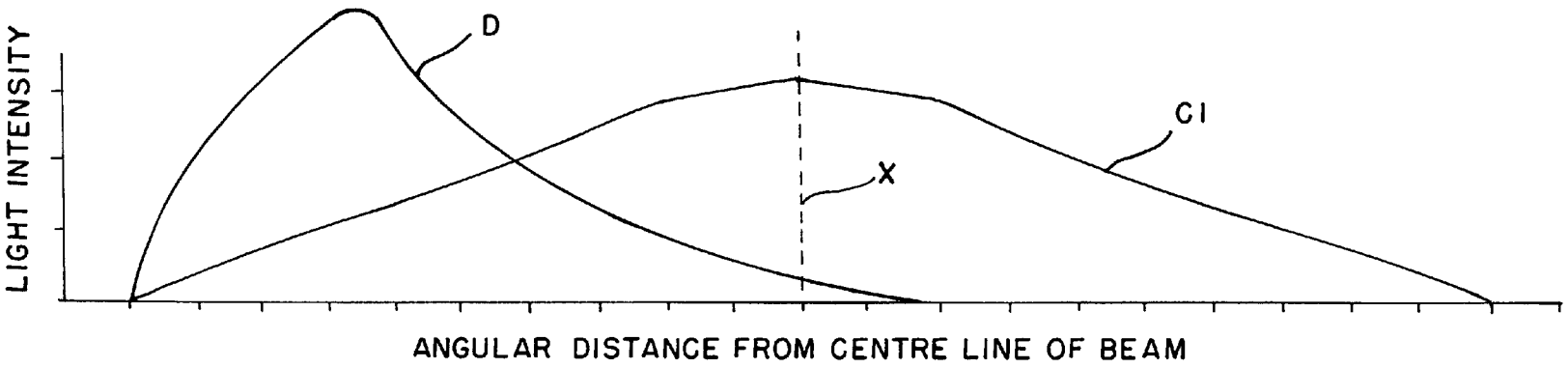
FIG. 1 (PRIOR ART)
FIG. 1 shows the pattern of light distribution of light produced by a two prior art light projection apparatuses.
Figure 2:
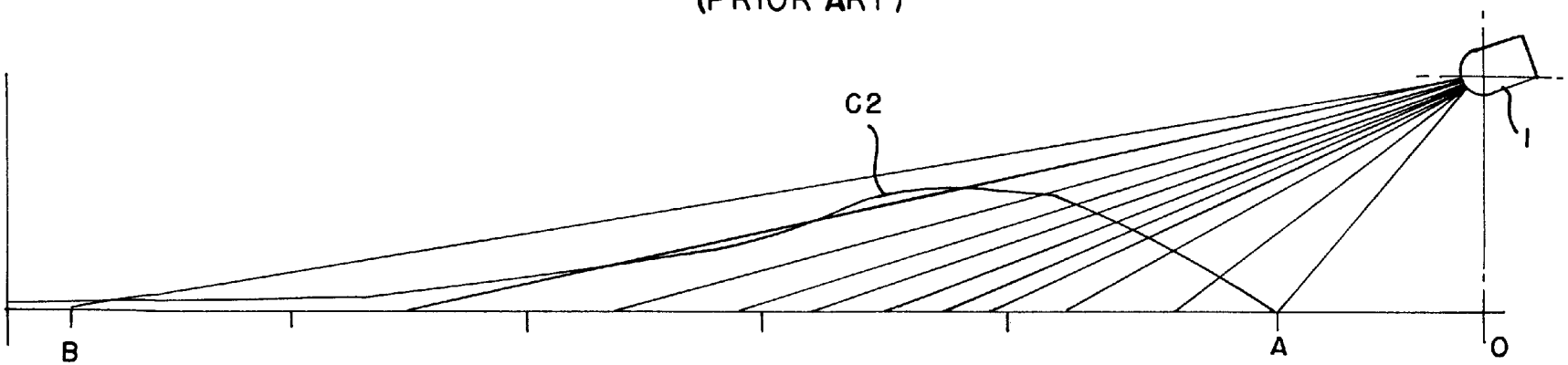
FIG. 2 (PRIOR ART)
FIG. 2 shows the typical layout of a prior art arrangement for producing a line on a workpiece.

The apparatus of the invention is on account of the configuration of the lens, able to illuminate a line on a surface at a position far closer to the apparatus than has been possible with prior art devices of this type while still providing good illumination over the full length of the workpiece surface. Thus, it will be noted, that the distance, indicated by the letters A'-O' in FIG. 4, is less than the distance A-0 depicted in FIG. 2. In practice it is found that with the light projection apparatus mounted about 1–2 m above the surface, the distance A'-0' will be approximately 0.5 m, whereas the distance A-0 of the prior art arrangement is approximately 2 m. This is considered to be advantageous in applications where there are space confinements. It is also advantageous in that there is a less acute angle of light incidence on the surface at the relevant position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A light projection apparatus for projecting an illuminated line onto a surface, the apparatus comprising:

a laser source for emitting a laser beam; and a hollow lens arranged to receive the emitted laser beam, the hollow lens projecting a working laser beam having a fanned planar configuration visible as a straight line projected obliquely onto the surface to form the illuminated line extending from a near position close to the hollow lens to a far position remote from the hollow lens, wherein the hollow lens has internal and external surfaces, the arrangement of the internal and external surfaces being such that the hollow lens both refracts and reflects the emitted laser beam to produce the working laser beam which has higher light intensity in portions of the working laser beam which are projected onto the surface towards the far position than in portions of the working laser beam which are projected onto the surface towards the near position, whereby the illuminated line has generally equal illumination along its length between the near and far positions.

2. The apparatus according to claim 1, wherein a center line axis of the lens is perpendicular to and spaced from a center line axis of the emitted laser beam.

3. The apparatus according to claim 2, wherein the emitted laser beam impinges on the lens an off-set distance from the center line axis of the lens such that a portion of the emitted beam passes through the lens and is refracted thereby, and a portion of the emitted beam is reflected off external and internal surfaces of the lens.

4. The apparatus according to claim 3, wherein portions of the working laser beam which are projected onto the surface towards the far position are primarily produced by refraction by the lens while portions of the working laser beam which are projected onto the surface towards the near position are primarily produced by reflection off the internal surface of the lens.

5. The apparatus according to claim 4, wherein the emitted laser beam has a transverse dimension less than half a diameter of the lens and the lens is positioned in relation to the emitted beam such that no portion of the emitted beam bypasses the lens without being refracted or reflected thereby.

6. The apparatus according to claim 1, wherein the apparatus is mountable to a support rail which is perpendicular to the plane of the working laser beam, the apparatus being movable relative to and securable in selected positions along the support rail.

7. The apparatus according to claim 6, wherein the apparatus further comprises a fine adjustment mechanism for fine adjustment of an angle of the apparatus relative to the support rail.

8. The apparatus according to claim 6, wherein the apparatus is adapted to move relative to the support rail.

9. The apparatus according to claim 1, wherein the light source is a laser diode.

10. The apparatus according to claim 1, wherein the light source is a Helium-Neon plasma tube.

11. The apparatus according to claim 10, wherein an anamorphic lens is positioned between the Helium-Neon plasma tube and the hollow lens to produce a laser beam of elliptical cross-section.

* * * * *